US007943010B2

(12) United States Patent
Pietikäinen et al.

(10) Patent No.: US 7,943,010 B2
(45) Date of Patent: May 17, 2011

(54) METHOD OF MAKING SURFACE-SIZED PAPER/BOARD

(75) Inventors: Reijo Pietikäinen, Järvenpää (FI); Mika Viljanmaa, Helsinki (FI); Juha Lipponen, Järvenpää (FI); Juha Pakarinen, Leppävesi (FI); Jussi Jääskeläinen, Jyväskylä (FI); Maria Lepola, Espoo (FI)

(73) Assignee: Metso Paper, Inc., Helsinki (FI)

( * ) Notice: Subject to any disclaimer, the term of this patent is extended or adjusted under 35 U.S.C. 154(b) by 688 days.

(21) Appl. No.: 11/720,394

(22) PCT Filed: Nov. 1, 2005

(86) PCT No.: PCT/FI2005/050386

§ 371 (c)(1),
(2), (4) Date: Apr. 28, 2008

(87) PCT Pub. No.: WO2006/058963

PCT Pub. Date: Jun. 8, 2006

(65) Prior Publication Data

US 2008/0295987 A1 Dec. 4, 2008

(30) Foreign Application Priority Data

Nov. 30, 2004 (FI) ..... 20045464

(51) Int. Cl.
*D21H 19/00* (2006.01)
*D21F 5/00* (2006.01)

(52) U.S. Cl. ..... 162/136; 162/197

(58) Field of Classification Search ..... 162/134, 162/135, 136, 137, 265, 206, 207, 184, 197, 162/270

See application file for complete search history.

(56) References Cited

U.S. PATENT DOCUMENTS

| | | | | |
|---|---|---|---|---|
| 3,344,493 | A * | 10/1967 | Telgheider | 26/99 |
| 6,001,421 | A * | 12/1999 | Ahonen et al. | 427/316 |
| 6,280,576 | B1 * | 8/2001 | Kuhasalo et al. | 162/252 |
| 6,416,628 | B1 * | 7/2002 | Huang et al. | 162/180 |
| 7,799,170 | B2 * | 9/2010 | Shakespeare et al. | 162/197 |
| 2003/0173046 | A1 * | 9/2003 | Jaaskelainen et al. | 162/140 |
| 2005/0251976 | A1 | 11/2005 | Lipponen et al. | |
| 2005/0251977 | A1 | 11/2005 | Lipponen et al. | |
| 2006/0060322 | A1 | 3/2006 | Viljanmaa et al. | |

FOREIGN PATENT DOCUMENTS

| | | |
|---|---|---|
| EP | 0 608 206 A1 | 7/1994 |
| FI | 90265 | 7/1992 |
| FI | 93044 | 7/1994 |
| WO | WO 83/01635 A1 | 5/1983 |
| WO | WO 03/064762 A1 | 8/2003 |
| WO | WO 03/064764 A1 | 8/2003 |

* cited by examiner

*Primary Examiner* — Eric Hug
(74) *Attorney, Agent, or Firm* — Alston & Bird LLP

(57) ABSTRACT

The invention relates to a method of making surface-sized paper/board. The web to be treated in the method is after surface sizing passed to a treatment process for providing a desired drying shrinkage and/or increase of drying stresses to create thereby a desired effect on the flexural strength and/or bulk of paper/board.

1 Claim, 4 Drawing Sheets

METHOD OF MAKING SURFACE-SIZED PAPER/BOARD

BACKGROUND OF THE INVENTION

1. Field of the Invention

The present invention relates to a method of making surface-sized paper/board.

2. Description of Related Art

In printing paper and board, a high flexural strength/bulk ratio is desirable for adequate runnability and printability. Flexural strength can be increased e.g. by surface sizing, as well as by various gradient structures (multiple structures as well as gradient calendering).

An objective of surface sizing is to improve the strength properties of paper or board, such as internal bond strength (interlaminar strength) and surface strength (picking) Chemicals for use in surface sizing are water-soluble polymers, comprising predominantly starches because of the attractive price thereof. The raw material for starches includes plants, such as corn, wheat, barley, potato, tapioca, etc., the tubers, seeds, etc. thereof being sources of starch. Starch ($C_6H_{10}O_5$) consists of straight-chain amylose and branched amylopectin. Other chemicals for use in surface sizing are e.g. various cellulose derivatives (CMC), as well as polyvinyl alcohol (PVA).

Flexural strength is reduced in calendering as the web compresses, resulting in a lower thickness and reduced bulk. Calculated flexural strength increases linearly as a function of thickness according to the following formulae:

$$S_1/S_2=(E_1h_1^3)/(E_2h_2^3)$$

$$E_1/E_2=h_2/h_1$$

$$h_2h_1^3/h_1h_2^3=h_1^2/h_2^2$$

wherein:

$S_1$ and $S_2$ represent flexural strengths of calendered and uncalendered paper, respectively;

$h_1$ and $h_2$ represent thicknesses of calendered and uncalendered paper, respectively; and $E_1$ and $E_2$ represent elastic moduli of calendered and uncalendered paper, respectively.

The following general description deals with paper and board grades, as well as various calendering and coating processes for use in the manufacture thereof.

Paper and Board Grades

A wide range of various grades of paper and board are in existence and can be divided on the basis of basis weight in two categories: papers with a single ply and a basis weight of 25-300 g/m$^2$ and boards made in multiply technique with a basis weight of 150-600 g/m$^2$. As noted, the dividing line between paper and board is fluctuating, the boards of lowest basis weight being lighter than the heaviest papers. Ordinarily, paper is used for printing and board for packaging.

The following descriptions are examples of presently employed values for fibrous webs and substantial deviations from the given values may occur. The principal source publication for the descriptions is Papermaking Science and Technology, Papermaking Part 3, Finishing, edited by Jokio, M., published by Fapet Oy, Jyväskylä 1999, 361 pages, and Papermaking Science and Technology, Paper and Board grades, edited by Paulapuro, H., published by Fapet Oy, Jyväskylä 2000, 134 pages.

Printing papers made of mechanical pulp, i.e. those with a wood content, include newsprint, uncoated magazine and coated magazine paper.

Newsprint consists either completely of mechanical pulp or may contain some bleached softwood pulp (0-15%), and/or some of the mechanical pulp can be replaced by recycled fiber pulp. General values for newsprint can probably be considered as follows: basis weight 40-48.8 g/m$^2$, ash content (SCAN-P 5:63) 0-20%, PPS s10 roughness (SCAN-P 76-95) 3.0-4.5 μm, Bendtsen roughness (SCAN-P21:67) 100-200 ml/min, density 600-750 kg/m$^3$, brightness (ISO 2470:1999) 57-63%, and opacity (ISO 2470:1998) 90-96%.

Uncoated magazine paper (SC=supercalendered) comprises generally 50-70% of mechanical pulp, 10-25% of bleached softwood pulp, and 15-30% of fillers. Typical values for calendered SC paper (including e.g. SC−C, SC−B, and SC−A/A+) are basis weight of 40-60 g/m$^2$, ash content (SCAN-P 5:63) of 0-35%, Hunter gloss (ISO/DIS 8254/1) of <20-50%, PPS s10 roughness (SCAN-P 76:95) of 1.0-2.5 μm, density of 700-1250 kg/m$^3$, brightness (ISO 2470:1999) of 62-70%, and opacity (ISO 2470:1998) of 90-95%.

Table 1 shows typical values for coatable papers which contain mechanical pulp. (MFC=machine finished coated, FCO=film coated offset, LWC=light weight coated, MWC=medium weight coated, HWC=heavy weight coated)

Table 1

TABLE 1

| | MFC | FCO | LWC | MWC | HWC |
|---|---|---|---|---|---|
| basis weight, (g/m$^2$) | 50-70 | 40-70 | 40-70 | 70-90 | 100-135 |
| Hunter gloss (ISO/DIS 8254/1), (%) | 25-40 | 45-55 | 50-65 | 65-70 | |
| PPS-s10 roughness, (μm) (SCAN-P 76/95) | 2.2-2.8 | 1.5-2.0 | 0.8-1.5 (offset) 0.6-1.0 (roto) | 0.6-1.0 | |
| density, (kg/m$^3$) | 900-950 | 1000-1050 | 1100-1250 | 1150-1250 | |
| brightness (ISO 2470:1999), (%) | 70-75 | 70-75 | 70-75 | 70-75 | |
| opacity (ISO 2470:1998), (%) | 91-95 | 91-95 | 89-94 | 89-94 | |

Coated magazine paper (LWC=light weight coated) contains 40-60% of mechanical pulp, 25-40% of bleached softwood pulp, and 20-35% of fillers and coatings. HWC (heavy weight coated) can be coated even more than twice.

Woodfree printing papers made of chemical pulp, i.e. fine grade papers, include uncoated and coated printing papers based on chemical pulp, wherein the proportion of mechanical pulp is less than 10%.

Uncoated printing papers based on chemical pulp (WFU) have 55-80% of bleached birchwood pulp, 0-30% of bleached softwood pulp, and 10-30% of fillers. In WFU, the values fluctuate a great deal: basis weight 50-90 g/m$^2$ (up to 240 g/m$^2$), Bendtsen roughness 250-400 ml/min, brightness 86-92%, and opacity 83-98%.

In coated printing papers based on chemical pulp (WFC), the amounts of coating fluctuate a great deal according to requirements and intended application. The following are typical values for once- and twice-coated printing paper based on chemical pulp: once-coated, basis weight 90 g/m$^2$, Hunter gloss 65-80%, PPS s10 roughness 0.75-2.2 μm, brightness 80-88%, and opacity 91-94%, and for twice-coated, basis weight 130 g/m$^2$, Hunter gloss 70-80%, PPS s10 roughness 0.65-0.95 μm, brightness 83-90%, and opacity 95-97%.

Release papers have a basis weight which varies within the range of 25-150 g/m$^2$.

Board making involves the use of chemical pulp, mechanical pulp and/or recycled pulp. Boards can be divided e.g. for the following main categories according to intended application.

Corrugated board provided with a liner and a fluting.

Boxboards for making containers, boxes. Boxboards include e.g. liquid packaging boards (FBB=folding boxboard, LPB=liquid packaging board, WLC=white-lined chipboard, SBS=solid bleached sulfite, SUS=solid unbleached sulfite).

Graphic boards for making e.g. cards, files, folders, casings, covers, etc.

Wallpaper bases.

Calendering

The surface properties and thickness profile of various papers and boards are processed by calendering to meet the requirements of a printing method and further processing. Coated grades are typically precalendered before a coating process and subjected to final calendering after the coating process.

Calenders are grouped in machine calenders, soft calenders, and multi-roll calenders. A machine calender has typically 1-2 nips and both nip-forming rolls are hard rolls. A soft calender has generally 1-4 nips and at least one of the nip-forming rolls is covered with a soft cover. A multi-roll calender has generally 5-11 nips. The roll assembly of a multi-roll calender includes both heated rolls and soft cover rolls.

Special calenders include e.g. a wet stack calender, a breaker stack, and long-nip calenders.

Wet stack calender is more or less identical to a multi-roll machine calender, yet totally different in terms of calendering process. Wet stack calender makes effective use of a moisture gradient, the web arriving at the calender only having a moisture of about 1-2%. Wet stack calender is provided with water boxes for forming a water film on the web surface upstream of a nip, said film being pressed to the web surface in the nip. Thus, the web only becomes wet at the surface, whereby the surface receives more calendering than the overdried interior. Wet stack calender is employed as a precalender for several board grades.

Breaker stack is a machine calender located in the drying section of a paper machine.

Long-nip calenders include a shoe calender, which has a soft belt around a shoe roll and in which the nip length is typically 50-400 mm, as well as belt calenders. The traditional belt calender consists of a soft calender's thermal roll, a belt loop, and a backing roll inside the belt loop, the latter being either a hard roll or a soft roll. The belt runs over the backing roll and guide/tension rolls. A special embodiment of the belt calender is a metal belt calender, wherein the calendering belt comprises a metal belt which travels around guide rolls and establishes, together with a counter-element, typically a roll, a long nip zone having a length of even more than 5000 mm. Inside the belt loop can be further provided a press element, e.g. a deflection-compensated roll, which can be used for establishing a nip point of higher compression load midway across the long nip zone.

Coating Techniques

With coated paper grades and coating as a method becoming more and more popular, the coating processes and equipment are challenged by increasing demands. In coating procedure, more specifically in pigment coating procedure, the surface of paper is formed with a layer of coating color at a coating head, followed by performing the draining of excess water. The forming of a coating color layer can be divided in supplying a coating color onto the surface of paper, i.e. application, as well as in adjusting the final amount of coating. The most important pigment coating method is so-called blade coating, in which the amount of coating is adjusted by means of a so-called doctor blade. The most common types of blade coating heads include a blade coater provided with a applicator roll and a blade coater provided with jet application. The coating process additionally involves the use of a so-called film transfer coater, the use of which has recently become more and more common. Another new technique being introduced involves the use of curtain coaters.

From a practical standpoint, the most essential difference between various coating devices relates to the application process and especially to the penetration occurring therein, i.e. to the penetration of a coating color into the paper.

In the manufacture of high-grade coated printing papers, more and more attention has been lately paid not only to high quality but also to productivity. Quality has likewise become a more important aspect in light coated papers of a bulk product type. Nearly all coaters are under pressure of raising quality, productivity, and running speed.

In applicator-roll application included in blade coating, the application is effected by using a roll rotating in a coating pan for picking up coating color onto the bottom surface of paper carried by a backing roll. The applied amount is normally 200-250 g/m$^2$. In applicator-roll application, the coating color penetrates effectively into base paper. In addition, the fibers of base paper have time to swell prior to doctoring, thus increasing the paper's roughness volume.

In jet application, the coating color is in turn supplied directly onto the web surface by means of a nozzle. An advantage over the applicator-roll application is the absence of a rotating roll and hence improved aptitude to high running speeds. Another advantage is a less powerful pulse of application pressure, resulting in improved runnability. In jet application, the web wetting process is an intermediate between a applicator roll and a short dwell. In jet application, the applied amount is typically 130-220 g/m$^2$.

In short dwell application, the coating color is delivered into an application chamber located immediately behind the doctor blade, one side wall of said chamber being constituted by a moving paper web supported by the backing roll. The moving paper web develops vortices in the application chamber and the coating color has a flowing speed on the paper web's surface which is equal to the paper web's speed. In short dwell application, the wetting of paper is slight as the application zone is subjected to a low pressure and the effective range is short. The swelling of paper fibers occurs partially only downstream of the doctor blade, which roughens the surface smoothed by the blade. Thus, the coating smoothness obtainable by a short dwell coater is inferior to what is achieved by applicator-roll and jet coaters.

The amount of coating remaining on the surface of paper is influenced by a wide range of variables. When such properties of base paper as roughness, porosity, and water absorption, are increasing, the amount of coating will also increase. Likewise, when the dry content and viscosity of a coating color are increasing, the amount of coating will increase. On the other hand, an increase in the water retention capacity of a coating color reduces the amount of coating. When the stress, working angle and blade thickness of a doctor blade are increasing, the amount of coating will in turn be reduced. As for other factors, an increase in running speed, as well as an increase in application pressure, lead to an increase in the amount of coating.

In addition to the above-described blade coaters, the coating and surface treatment can also be implemented by other devices. The following describes a few most commonly employed options. The size press unit consists of two rotating rolls. In this alternative, the coating color to be applied onto the surface of a web is applied to the web in a pond present between the web and the rolls. In addition to surface sizing, the size press can also be used for pigment coating. The amount of coating will be about 1.0-2.0 g/m$^2$/side. A problem in the standard size press has been instability of the application pond at high rates of running speed.

Attempts have been made to eliminate the problem by designing film size presses, wherein a layer of coating or sizing agent desired on the surface of a paper web is first applied to the surface of press rolls, the layers passing therefrom to paper in a nip between the rolls. The employed application devices comprise units like short dwell coaters. Advantages gained by the apparatus include a controlled application even at high running speeds and a possibility of pigment coating (2-6 g/m$^2$/side). Furthermore, the coating color can have its dry content increased with respect to a standard size press. The coating of film coating colors can be carried out either in a one- or two-sided manner. The runnability of a film transfer coating process is usually good with respect to blade coating. Compared to blade coating, the coating layer obtained by film transfer coating usually conforms better to the contour and has more coverage in that sense. It is not possible, however, to achieve high amounts of coating by film transfer coating.

In air brush coating, the application of a coating color is performed either by a single- or a multi-roll blade application apparatus or by means of a nozzle. Adjustment of the amount of coating and smoothing of the surface are in turn performed by means of an air jet. Air brush coating is used almost exclusively in board coating because of an excellent coverage provided thereby. Downsides include a limited running speed of the method and quite low dry contents of the coating color. The coating layer formed by an air brush is of a consistent thickness, conforming to the surface contours of paper.

Accordingly, basic solutions today in terms of coating a paper web are provided by short dwell and applicator-roll coaters, equipment based on jet application, and film size presses. An all-purpose general coater is yet to be designed.

Blade coating in its various forms is and seems to remain also in the future the most common coating method. As running speeds increase and areas for applied coating expand, the applicator roll will probably be replaced almost totally by solutions based on jet application.

One emerging new technique is also a so-called curtain coating technique. Curtain coaters can be divided in slot-fed or slide-fed coaters. In a slide-fed curtain coater, a coating is set flowing along an inclined plane and a curtain develops as the coating trickles over the plane's edge. In slot-fed application beams, a coating is pumped through a distribution chamber to a narrow vertical slot, a curtain developing along its lip and trickling down to the web. A coating can be applied in one or more layers. Compared to blade coating, curtain coating applies a much lesser force on the web and thus results in fewer disruptions caused by breaks in the paper web, thus improving runnability. Curtain coating is not capable of providing a smoothness equal to that achieved by blade coating, but the coverage obtained thereby is better than what is achieved by blade coating. The principal idea has been that the curtain coater would eventually replace the air brush.

BRIEF SUMMARY OF THE INVENTION

It is an objective of the present invention to provide a solution capable of improving the flexural strength and bulk of surface-sized paper/board with respect to values obtained by standard surface sizing and subsequent calendering. In order to accomplish this objective, a method of the invention is characterized in that the web to be treated in the method is after surface sizing passed to a treatment process for providing a desired drying shrinkage and/or increase of drying stresses to create thereby a desired effect on the flexural strength and/or bulk of paper/board.

Preferred embodiments of the invention are defined in the dependent claims.

The inventive method enables providing an equal flexural strength with a smaller amount of surface sizing agent or with a smaller amount of material as compared with a traditional method.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 shows the relationship of a calculated and measured flexural strength with the thickness in specimens subjected to two different calendering processes;

FIG. 2*a* shows the effect of the amount of surface sizing agent and its drying process on the basis weight of paper;

FIG. 2*b* shows the effect of the amount of surface sizing agent and its drying process on the thickness of paper;

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

According to the invention, it has been discovered that the flexural strength and/or bulk of surface-sized paper/board can be improved by following the surface sizing with a treatment process for inhibiting or limiting a drying shrinkage effect to provide increased drying stresses. This phenomenon is based on a drying shrinkage promoting effect of starch, whereby the inhibition of drying shrinkage after the addition of starch leads to increased drying stresses. An increase in drying stress works at fiber level the same way as wet straining, i.e. the thickness of paper increases. The paper thickness promoting effect of wet straining is a phenomenon known as such, e.g. from publication Papermaking Science and Technology, part Paper Physics, pp. 82-83, edited by Niskanen, K., published by Fapet Oy, Jyväskylä 1998. The development of drying stresses can also be encouraged by expanding the web.

Figure 1:
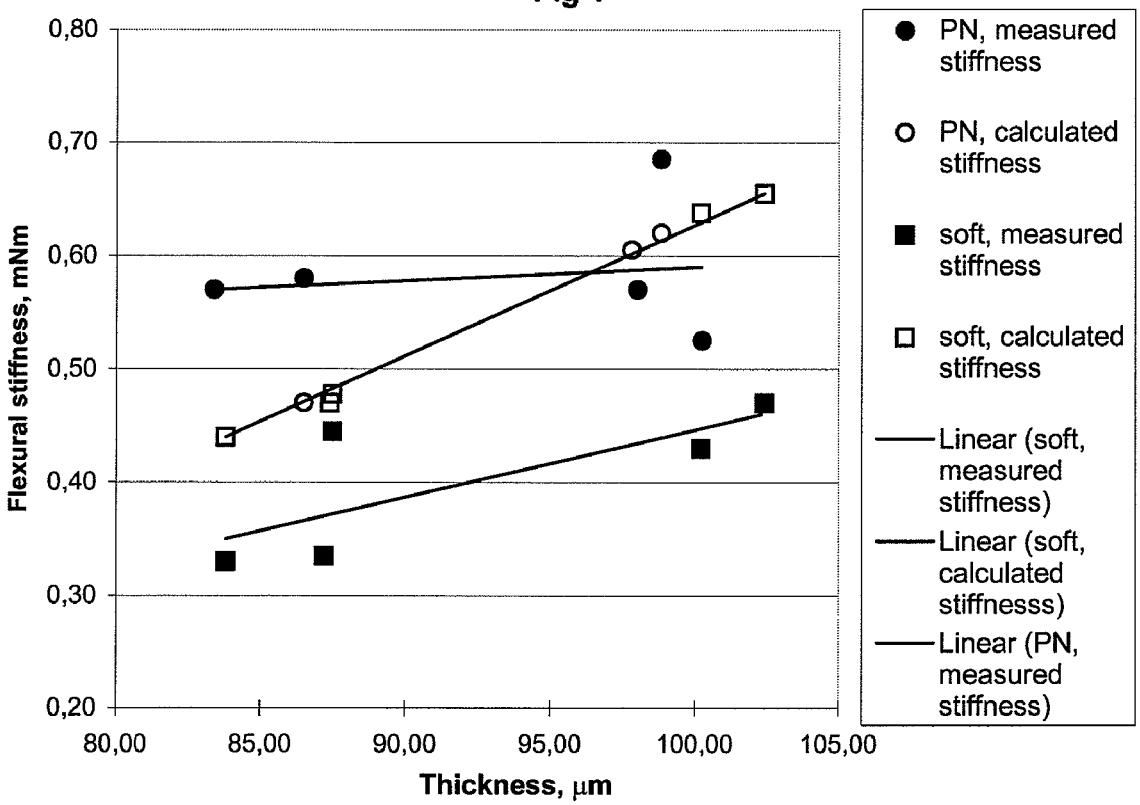

Referring to FIG. 1, the relationship of calculated and measured flexural strength to thickness has been illustrated in specimens calendered by two different procedures. The calendering procedures were soft calendering and long-nip metal belt calendering, the latter being designated with letters PN in FIG. 1. In soft-calendered measured specimens, flexural strength is reduced as a function of thickness as can be expected on the basis of calculated flexural strength. Between calculated and measured flexural strength is discovered a level disparity, which is presumably due to a rough, fiber-violating treatment delivered by soft calendering. The level disparity is not observed in the metal belt calender as the compression takes place with fibers in a plastic state. The measured flexural strength of metal-belt calendered specimens does not deteriorate as a function of thickness as steeply as the flexural strength of soft-calendered specimens. For example, the flexural strength in a metal-belt calendered specimen at the thickness of 100 μm is approximately 34% higher than in a soft-calendered specimen, respectively at the thickness of 85 μm the flexural strength improves by about 58% relative to soft calendering and by 27% relative to calculated flexural strength. By using metal belt calendering in a treatment process downstream of surface sizing, the drying of a web can be effected while the web is supported in a closed nip established between the metal belt and a roll to enable a controlled development of drying stresses. By virtue of controlled drying shrinkage/stresses, the web will improve both in terms of its tensile strength as well as its flexural strength and bulk. This results in major savings in raw materials as well upgrades in quality. The adhesive effect of a surface sizing agent is enhanced in metal belt calendering as a result of temperature, moisture, dwell, as well as load, because the sizing agent (e.g. starch) melts/softens/plasticizes during a calendering process. In compression, the interfibrous adhesive joints experience strengthening of interfiber bonds, interfibrous adhesive bonds, as well as an enlargement of effective bonding area. The bond strength increases as plasticized fibers, lignin or chemicals added into paper become bonded/give strength to bonds already there. The formation of bonds requires a high moisture content. Such moisture levels are not achievable in traditional calendering methods. It is likely, however, that the moisture in paper be distributed unevenly, whereby local moisture contents (e.g. in starch molecules) might reach quite high levels indeed. Thus, the formation of hydrogen bonds, for example, between starch molecules or even between fibers would be possible.

Figure 2A:
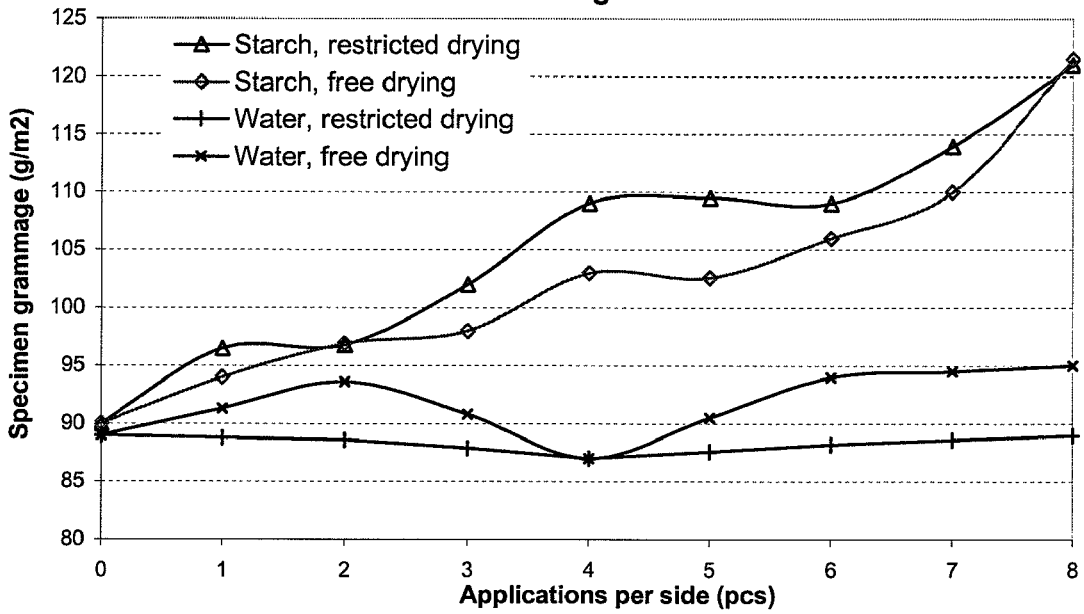
Figure 2B:
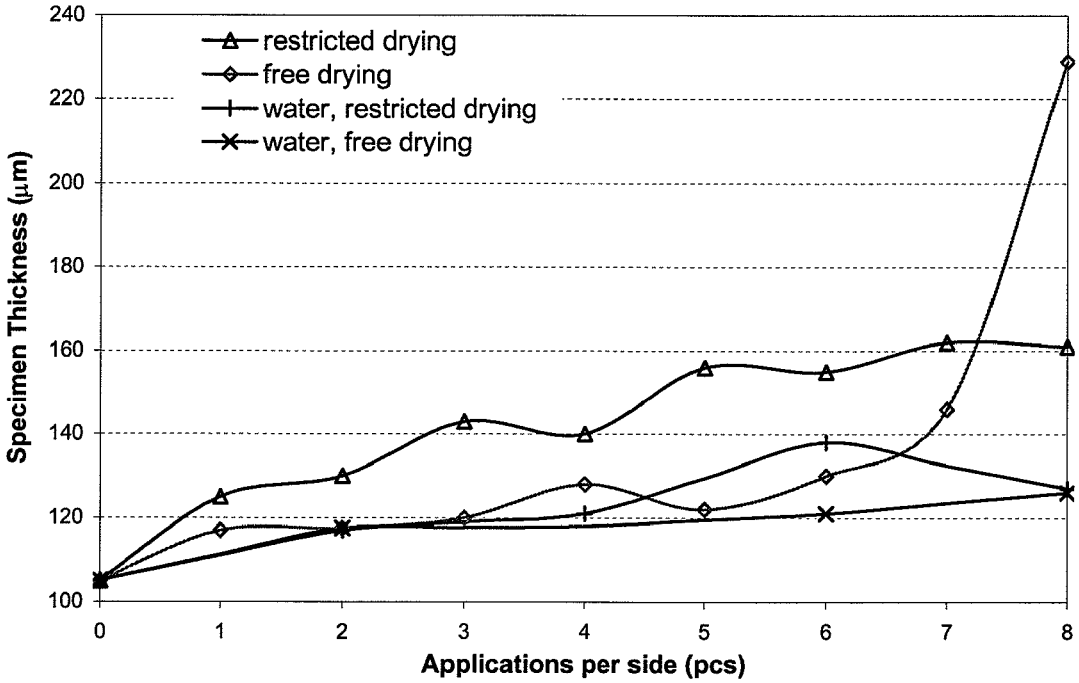

FIG. 2*a* illustrates the experimentally discovered effect of the amount and drying process of a surface sizing agent on the basis weight of paper, and FIG. 2*b* shows the effect of the amount and drying process of a surface sizing agent on the thickness of paper. It can be seen from FIG. 2*b* that the thickness of paper can be increased by restricting drying shrinkage.

Figure 3:
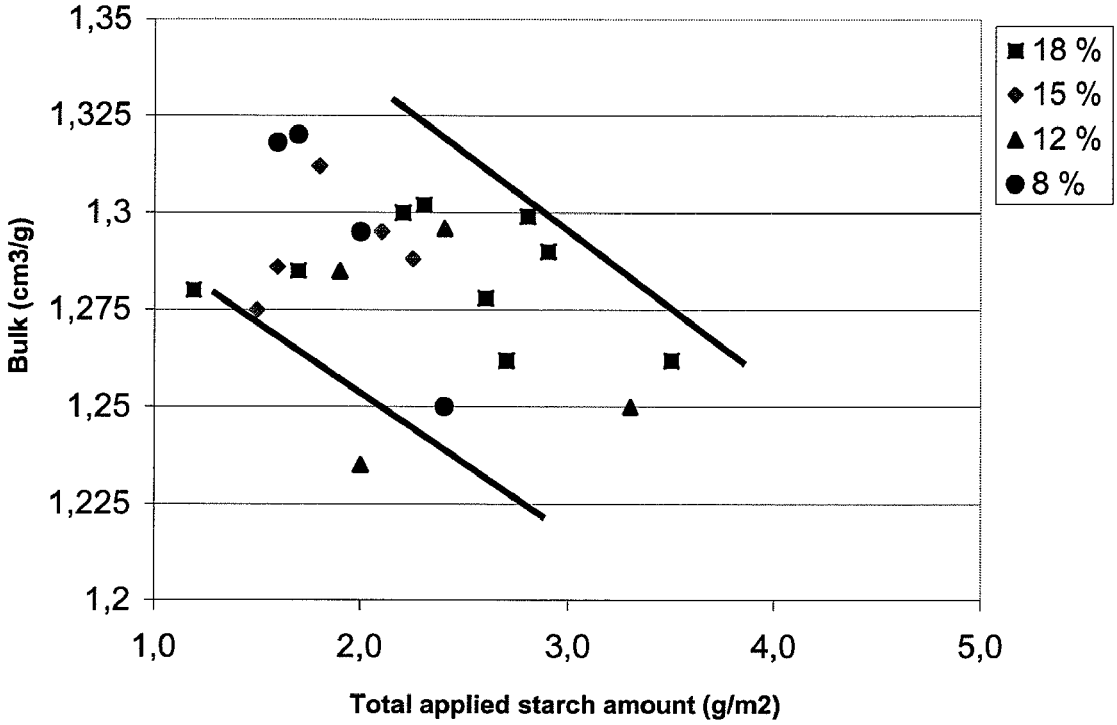
FIG. 3 shows the effect of the amount of surface sizing agent on the bulk of paper.

FIG. 3 illustrates the effect of the amount of a surface sizing agent on the bulk of paper. As shown in FIG. 3, surface sizing results traditionally in a bulk reduction of about 4-5%.

Figure 4:
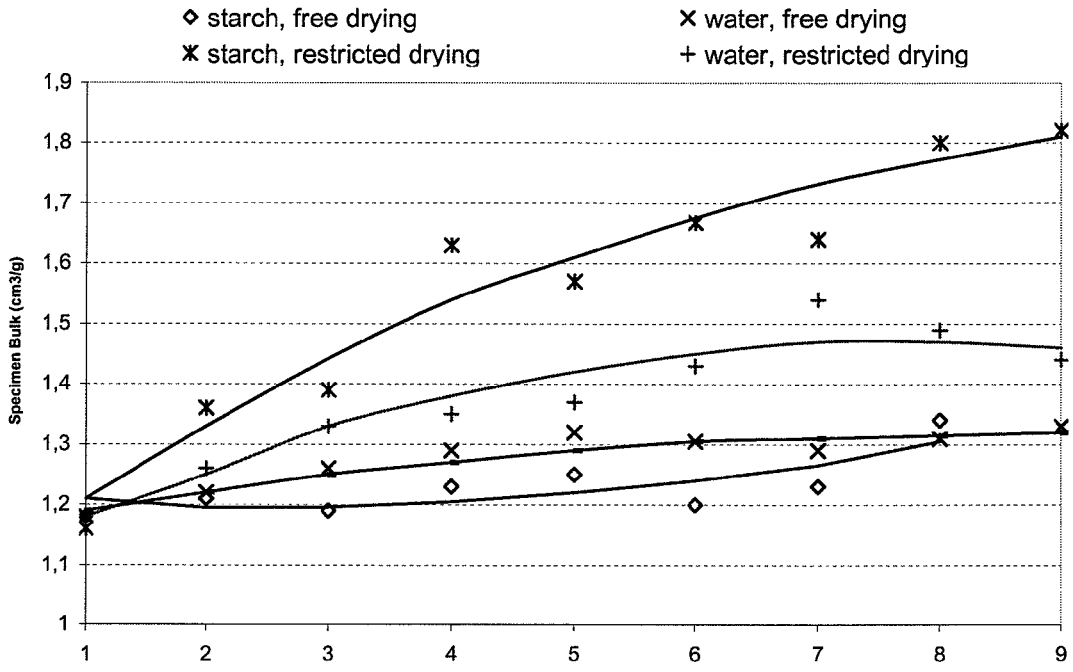
FIG. 4 shows the effect of the amount of surface sizing agent and its drying process on the bulk of paper.

FIG. 4 illustrates the effect of the amount and drying process of a surface sizing agent on the bulk of paper. On the basis of FIG. 4, it can be seen that increasing the amount of a surface sizing agent leads to a deterioration of bulk. However, bulk can be improved by inhibiting the drying shrinkage subsequent to surface sizing.

Figure 5:
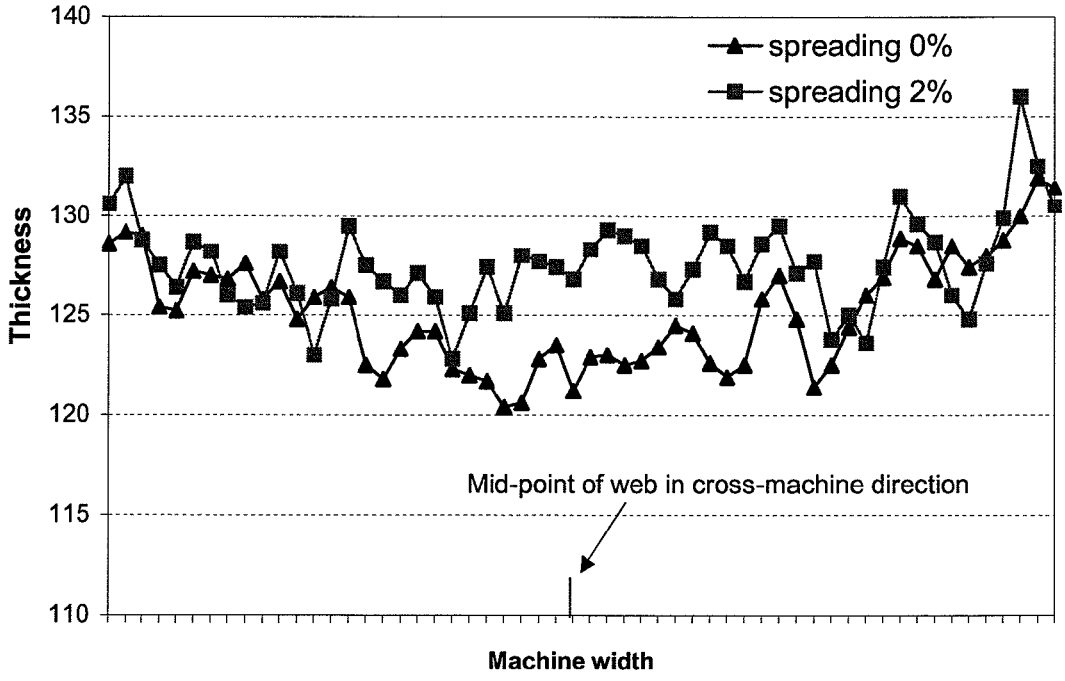
FIG. 5 shows the effect of a paper web spreading on the thickness of paper.

FIG. 5 shows the effect of a paper web spreading on the thickness of paper. The degree of spreading was 0% and 2% and the paper web had a KAP of 42%. A spreader roll can be designed e.g. by fitting the roll with separately bearing-mounted roll end pieces provided with vacuum holes, said end pieces engaging web edges by means of said vacuum holes and said roll end pieces being installed in an angular position guiding the web edges outward. It is indicated in FIG. 5 that the thickness of paper increases as the spreading proceeds.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of making paper or board, comprising:

surface-sizing a fibrous web; and increasing drying stresses in the fibrous web by limiting drying shrinkage in a treatment process following surface-sizing of the fibrous web so as to obtain a measured change of flexural strength of between about 45% and about 95% less than a calculated change of flexural strength for a selected fibrous web thickness, and such that the fibrous web increases between about 0.5% and about 10% in thickness with respect to a non-surface-sized fibrous web, and wherein:

the treatment process is performed with a spreader roll, including engagement elements configured to engage edges of the fibrous web and to guide the edges so as to expand the fibrous web; and the engagement elements comprise separately bearing-mounted roll end pieces defining vacuum holes, said end pieces being configured to engage the edges of the fibrous web via said vacuum holes, and said roll end pieces being installed in an angular position for guiding the edges of the fibrous web outward.

* * * * *

UNITED STATES PATENT AND TRADEMARK OFFICE

CERTIFICATE OF CORRECTION

PATENT NO. : 7,943,010 B2
APPLICATION NO. : 11/720394
DATED : May 17, 2011
INVENTOR(S) : Pietikainen et al.

It is certified that error appears in the above-identified patent and that said Letters Patent is hereby corrected as shown below:

Title Page

"(75) Inventors: Reijo Pietikäinen, Järvenapää (FI); Mika Viljanmaa, Helsinki (FI); Juha Lipponen, Järvenapää" (FI); Juha Pakarinen, Leppāvesi (FI); Jussi Jääskeläinen, Jyväskylä (FI); Maria Lepola, Espoo (FI)" should read --(75) Inventors: Reijo Pietikäinen, Järvenapää (FI); Mika Viljanmaa, Helsinki (FI); Juha Lipponen, Järvenapää (FI); Juha Pakarinen, Leppāvesi (FI); Jussi Jääskeläinen, Muurame (FI); Maria Lepola, Espoo (FI),--

Signed and Sealed this
Seventh Day of February, 2012

David J. Kappos

David J. Kappos
*Director of the United States Patent and Trademark Office*